US005477924A

United States Patent [19]

Pollack

[11] Patent Number: 5,477,924

[45] Date of Patent: Dec. 26, 1995

[54] OFFSHORE WELL GAS DISPOSAL

[75] Inventor: Jack Pollack, Calabasas Hills, Calif.

[73] Assignee: Imodco, Inc., Calabasas Hills, Calif.

[21] Appl. No.: 360,971

[22] Filed: Dec. 20, 1994

[51] Int. Cl.[6] ..... E21B 43/01

[52] U.S. Cl. ..... 166/357; 166/267; 585/500

[58] Field of Search ..... 166/357, 265, 166/267, 310, 335, 352; 585/500, 502, 503

[56] References Cited

U.S. PATENT DOCUMENTS

| | | | |
|---|---|---|---|
| 2,184,096 | 12/1939 | Gerhold . | |
| 3,601,302 | 8/1971 | Chai . | |
| 3,608,630 | 9/1971 | Wooden | 166/357 |
| 4,041,721 | 8/1977 | Kniel . | |
| 4,088,193 | 5/1978 | Colgate . | |
| 4,199,533 | 4/1980 | Benson . | |
| 4,322,225 | 3/1982 | Bellinger . | |
| 4,375,835 | 3/1983 | Archer | 166/357 X |
| 4,513,164 | 4/1985 | Olah . | |
| 4,547,149 | 10/1985 | Chaudot | 166/357 X |
| 4,547,607 | 10/1985 | Jones . | |
| 4,704,496 | 11/1987 | Paparizos et al. . | |
| 4,793,418 | 12/1988 | Wheeler et al. | 166/357 |
| 4,801,762 | 1/1989 | Leyshon . | |
| 4,982,794 | 1/1991 | Houdt | 166/357 |
| 5,023,391 | 6/1991 | Han et al. . | |
| 5,025,860 | 6/1991 | Mandrin | 166/267 |
| 5,093,542 | 3/1992 | Gaffney . | |
| 5,117,914 | 6/1992 | Blandford | 166/352 X |
| 5,157,189 | 10/1992 | Karra . | |
| 5,161,619 | 11/1992 | Bollich . | |
| 5,232,475 | 8/1993 | Jepson | 166/357 X |
| 5,245,124 | 9/1993 | Miremadi et al. | 585/500 |
| 5,288,935 | 2/1994 | Alario et al. | 585/500 X |

*Primary Examiner*—Frank S. Tsay
*Attorney, Agent, or Firm*—Freilich Hornbaker Rosen

[57] ABSTRACT

A system is provided for disposal of gaseous hydrocarbons produced from an undersea well, which minimizes the gas disposal cost. The system includes a polymerization station (80) mounted on an anchored floating vessel arrangement (12), which converts the gas to a liquid hydrocarbon that is stored and then transported by a shuttle tanker (52) to a refinery. The liquified gas can be mixed with liquid hydrocarbons originally obtained from the undersea well, both in the shuttle tanker and in storage tanks on the anchored vessel arrangement. Sea water can be used to create steam for the polymerization process.

9 Claims, 1 Drawing Sheet

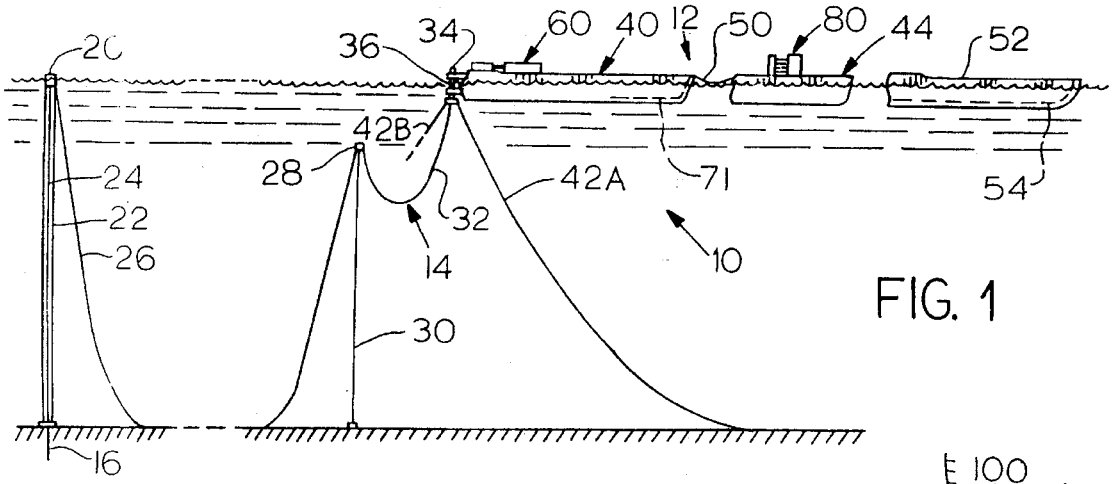
FIG. 1
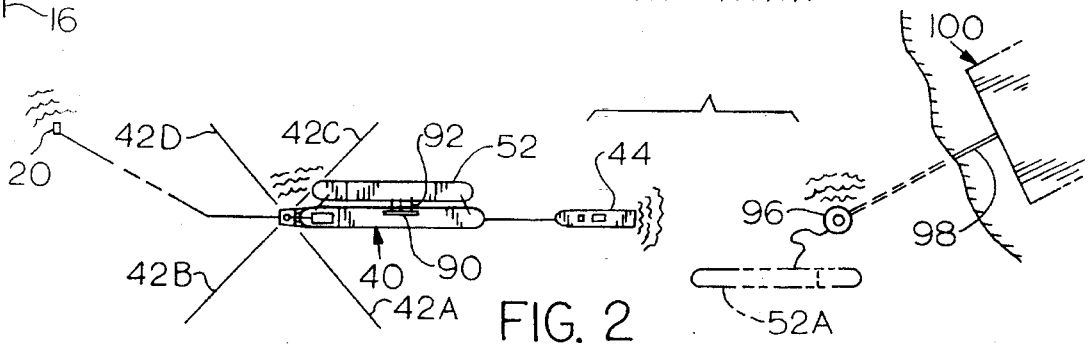
FIG. 2
FIG. 3
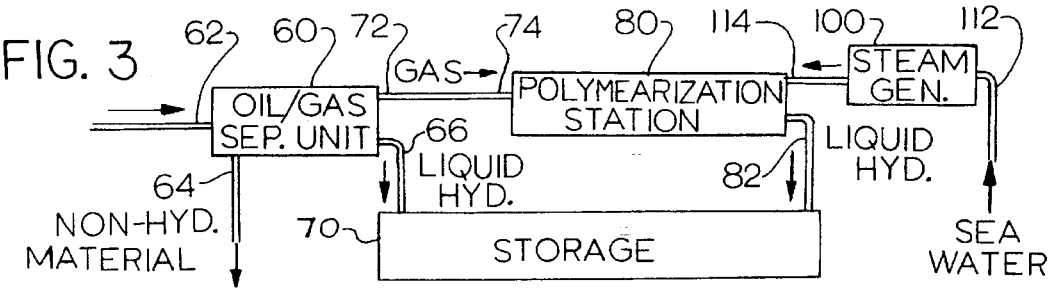
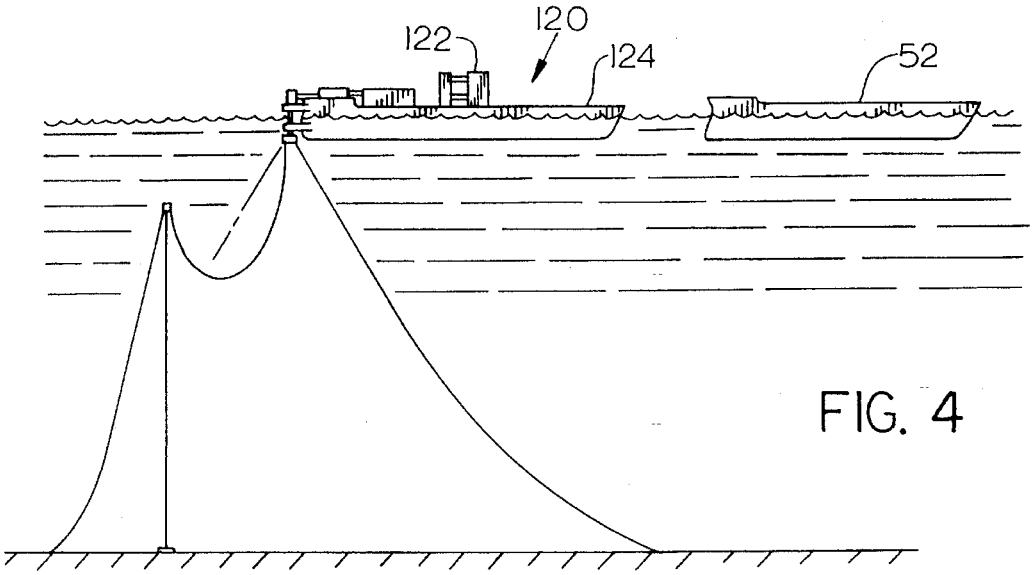
FIG. 4

OFFSHORE WELL GAS DISPOSAL

BACKGROUND OF THE INVENTION

A great majority of offshore oil fields produce both liquid and gaseous hydrocarbons. Once the liquid hydrocarbons are separated for storage, a large quantity of the natural gas must be disposed of. It is often uneconomical to build a sea floor gas pipeline to transport the gas to a shore-based or other gas processing facility. One alternative is to reinject the gas into the undersea well, but it is often uneconomical to construct the required compressor and reinjection facility, especially where the production system includes a weathervaning vessel floating at the sea surface. Unlike a fixed platform, it is technically more difficult for a floating vessel to be used as a recompression station due to vessel motions and the need for a high pressure fluid swivel to carry reinjected gas to the to the reservoir. Where possible, it is usually most economical to flare the gas, that is, to burn the gas. However, long term flaring of gas is not allowed in many areas of the world because of environmental concerns, and even where allowed, flaring can be dangerous. An improved method for the disposal of gaseous hydrocarbons at a floating and anchored vessel arrangement that receives hydrocarbons from sea floor wells, would be of considerable value.

SUMMARY OF THE INVENTION

In accordance with one embodiment of the present invention, an offshore hydrocarbon production system is provided, of the type that includes an anchored weathervaning floating vessel arrangement, which effectively disposes of gaseous hydrocarbons. The apparatus includes an oil/gas separation unit mounted on the vessel arrangement, the separation unit delivering original liquid hydrocarbons from the well to a storage facility on the vessel arrangement and delivering gaseous hydrocarbons to a polymerization station mounted on the vessel arrangement. The polymerization station has equipment that polymerizes the gaseous hydrocarbons to produce liquid hydrocarbons. The polymerized liquid hydrocarbons are preferably mixed with the original liquid hydrocarbons obtained from the well, in the same storage facility on the vessel arrangement and in a shuttle tanker which takes the liquid hydrocarbons to a distant refinery. The vessel arrangement preferably includes a storage vessel that includes storage tanks and a separator unit, and which is connected through a fluid swivel to the undersea well. The vessel arrangement also may include a separate gas-processing vessel that contains the polymerization station, so the gas-processing vessel can be separately moved away for repairs, or in the event of approaching adverse weather, or for reuse at any location. The polymerization station can include a water inlet that draws water from the sea to create steam used in a polymerization process, and can use sea water to cool the polymerized oil.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of an offshore hydrocarbon production system constructed in accordance with one embodiment of the present invention.

FIG. 2 is a plan view of the system of FIG. 1, and also showing, in pantomimes, the shuttle tanker unloading its cargo at a shore-based refinery.

FIG. 3 is a block diagram showing processing of effluent from the undersea well.

FIG. 4 is a side elevation view of an offshore hydrocarbon production system constructed in accordance with another embodiment of the invention.

DESCRIPTION OF THE PREFERRED EMBODIMENTS

FIG. 1 illustrates an offshore hydrocarbon production system 10 which includes a floating anchored vessel arrangement 12 that is connected through a production conduit 14 to a seabed or sea floor well 16. The particular system shown includes a tension leg platform 20 held over the well 16 by tendons 22 and connected thereto by a riser 24 which is part of the conduit 14. The top of the riser is connected to a fluid line 26 that extends along the sea floor and up to a buoy 28 that is anchored by a line 30 to the sea floor. A hose 32 of the conduit carries the output of the well to a fluid swivel 34 at the top of a transfer structure 36 that is held by a storage vessel 40 of the vessel arrangement. The storage vessel 40 is often referred to as an FPSO (floating production storage and offloading) vessel. The storage vessel is anchored to the sea floor by a group of catenary chains 42 A–42D. The vessel arrangement also includes a gas processing vessel 44 which is connected through a connection 50 that includes a hawser and flow lines, to the storage vessel 40. FIG. 1 also shows a transport or shuttle tanker 52 with containers 54 for storing oil (liquid hydrocarbons).

Hydrocarbons obtained from the seabed well 16 pass through the conduit 14 and fluid swivel 34 to a separator unit 60 on the storage vessel 40. The output of the well, for most undersea hydrocarbon reservoirs, includes liquid hydrocarbons (liquid at the temperature of the sea), gaseous hydrocarbons (which are gaseous at atmosphere pressure and sea temperature), and non-hydrocarbon material such as water and sand. The output of the well is typically at a high pressure, and the pressure is greatly reduced to separate the liquid from the gas and from the water and sand.

As shown in FIG. 3, the separator unit 60 takes the well effluent received on its inlet 62 and dumps much of the non-hydrocarbon material through an outlet 64 (usually into the sea after treatment). The separator delivers original liquid hydrocarbon through an outlet 66 to a storage facility 70. As shown in FIG. 1, a set of storage tanks 71 of the storage vessel 40 commonly occupies most of the volume of the storage vessel and forms part or all of the storage facility. As shown in FIG. 3, the gaseous hydrocarbons produced by the well are transferred through a separator outlet 72 to a feedstock inlet 74 of a polymerization station 80. The polymerization station links the small molecules that form the gaseous hydrocarbons, to produce longer chain hydrocarbons which are liquid at sea temperature (usually between about 4° C. and 22° C.). The station 80 has an outlet 82 through which it delivers liquified, or polymerized liquid hydrocarbons to the storage facility 70 and/or to storage capacity on the processing vessel 44. The storage capacity on the storage vessel 40 and any storage capacity on the processing vessel 44, forms the storage facility 70.

The original liquid hydrocarbons produced from the offshore sea floor well, commonly include many different liquid hydrocarbon molecules as well as other liquids. Since the natural gas produced by the well also includes a variety of hydrocarbon molecules, or compounds, (but usually at least about 80% is methane) the polymerized hydrocarbons delivered by the station 80 through outlet 82 to the storage tank, also usually includes a variety of compounds. Applicant prefers to store the original hydrocarbons delivered to the tank at 66 and the polymerized hydrocarbons delivered to the tank at 82, in a mixture wherein they are mixed together. It would be possible to separate them and store them in separate containers, but there are advantages in mixing them. One advantage is that the storage capacity of the storage facility 70 can be efficiently utilized, because if the ratio of original liquid and polymerized liquid changes, this does not result in one container being filled while the other is largely empty with much of it's storage space not being used. Another advantage is that the original liquid in the storage facility 70 can help to cool the usually hot polymerized oil delivered over outlet 82 to the storage tank. The polymerized oil is usually hot because most polymerization processes require heating of the gas to react it.

As indicated in FIG. 1, the polymerization station 80 can be located on a separate seaworthy vessel 44 (or on the storage vessel 40). The polymerizing equipment at station 80 is complex and may require major repairs that cannot be readily accomplished in the field. By placing the equipment on a separate vessel, applicant is able to detach the gas processing vessel 44 from the storage vessel 40 when repairs are needed, to repair the polymerization equipment. During a temporary absence of the processing vessel 44, it is generally possible to flare the gas, but if flaring is not allowed then production can stop. The processing vessel 44 also will move away in the event that adverse weather is approaching, which the storage vessel 40 can withstand. This is because the processing vessel 44 may not be separately anchored to the sea floor. An additional advantage in placing the polymerizing equipment on a separate vessel is that this allows it to be easily reused at another offshore field. The separation unit, which is a major component of the storage vessel 40, may not be reusable without large modifications, due to large variations in pressure, oil/gas ratios, percent water, sulfur content, etc. However, gas from a well consists of about 80% methane in most hydrocarbon reservoirs, so the polymerization equipment usually can be used elsewhere with little modification. It should be realized that it is usually desirable to place the polymerization equipment on the same vessel 40 as the separation equipment, to permit operation in rough seas.

FIG. 2 shows the shuttle tanker 52 lying beside the storage vessel 40, and with offloading equipment 90 being used to pump oil from the storage tanks through fluid-receiving couplings 92 to the storage area (not shown) of the shuttle tanker 52. The original liquid hydrocarbons from the well may be mixed with the polymerized liquid hydrocarbons in the storage tanks of the shuttle tanker 52. It is noted that the shuttle tanker 52 is of about the same storage capacity as the storage vessel 40. FIG. 2 also shows the shuttle tanker at 52A offloading its cargo through an offshore termination 96 that is connected through a relatively short pipeline 98 to a shore-based refinery 100. At the refinery, the oil is further cleaned, and as required, the liquid hydrocarbons are separated into fractions for different uses. It is noted that during polymerization, applicant produces primarily short chain hydrocarbons such as diesel fuel, which minimizes or even avoids the need for cracking that fraction of the oil delivered to the refinery.

A large number of polymerization processes are known in the prior art for converting natural gas to liquids. One process includes the use of a quartz reactor containing 15% manganese and 5% $Na_4P_2O_7$ by weight which serves largely as a catalyst. The natural gas is assumed to contain primarily methane, and the methane is mixed with 10% volume of air and 15% volume of steam ($H_2O$) to produce liquid hydrocarbons. As shown in FIG. 3, such system involves the use of a steam generator 110 which has an inlet 112 that takes in sea water, and which has an outlet 114 that delivers steam. Sea water is used to cool the hot polymerized hydrocarbons, with the original liquid hydrocarbons providing further cooling when mixed with the warm polymerized hydrocarbons to minimize evaporation of volatiles.

It is possible for the liquified natural gas to provide greater value than the cost of building, operating, and maintaining the polymerization station and the vessel that holds it. However, the main benefit obtained by polymerizing the natural gas is to provide a means for disposing of the gas where it cannot be economically carried through a pipeline to a refinery. The method avoids the high cost for reinjecting the gas into the undersea well and avoids the danger and prohibitions against long term flaring of the gas in many regions of the world.

FIG. 4 illustrates an offshore hydrocarbon production system 120 which is similar to that of FIGS. 1 and 2, except that the polymerization station 122 (which is similar to station 80) is mounted on a vessel arrangement 124 which comprises a single vessel. The vessel 124 is otherwise similar to the vessel 40 of FIGS. 1 and 2. FIG. 4 also shows the shuttle tanker 52 which transports the liquid hydrocarbons. An important advantage of mounting the polymerization station 122 on the vessel 124 that is directly anchored to the sea floor, is that this permits operation (including polymerization of gas) during adverse weather. Also, an extra vessel and conduits to carry gas and/or oil between two vessels is eliminated. Some disadvantages are mentioned earlier.

Thus, the invention provides an offshore hydrocarbon production system which economically disposes of natural gas produced along with liquid hydrocarbons from undersea wells. The system includes an oil/gas separator mounted on a weathervaning vessel arrangement that floats at the sea surface and that is anchored, as by catenary chains, to the sea floor. The system also includes a polymerization station mounted on the vessel arrangement, which polymerizes the gaseous hydrocarbons to produce liquid hydrocarbons that can be more easily stored and transported. The polymerized liquid hydrocarbons can be mixed with the original hydrocarbons directly obtained from the well, and can be mixed when transported by a shuttle tanker to a refinery to obtain maximum utilization of the storage space and to allow the original liquid hydrocarbons to help cool the hot polymerized hydrocarbons produced in most polymerization methods. The vessel arrangement can include a storage vessel with a storage tank, and a separate gas-processing vessel that contains the polymerization station and that is seaworthy, but whose output may be delivered back to the storage vessel. The polymerization station may include a water inlet that draws water from the sea and that uses the water in a polymerization process to produce liquid hydrocarbons.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore hydrocarbon production system which includes a vessel arrangement floating at the surface of a sea and anchored to the sea floor at a predetermined location and having a production conduit coupled to a seabed well that produces gaseous hydrocarbons as well as liquid hydrocarbons, and having a storage facility, characterized by:

an oil/gas separation unit mounted on said vessel arrangement and coupled to said production conduit, said separation unit having a liquid hydrocarbon outlet connected to said storage facility to dump liquid hydrocarbons therein and having a gaseous hydrocarbon outlet;

a polymerization station mounted on said vessel arrangement and having a feedstock inlet connected to said gaseous hydrocarbon outlet of said separator and having a polymerized hydrocarbon outlet connected to said storage facility, said polymerization station having equipment that polymerizes gaseous hydrocarbons to produce hydrocarbons that are liquid at the temperature of said sea.

2. The system described in claim 1 wherein:

said liquid hydrocarbon outlet of said separator and said polymerized hydrocarbon outlet of said polymerization station, are both connected to a common volume of said storage facility so the hydrocarbons from both of said outlets mix with each other.

3. The system described in claim 1 wherein:

said vessel arrangement includes a storage vessel that includes a storage tank that is part of said storage facility, and a separate gas-processing vessel that contains said polymerization station and that is seaworthy so it can separately sail away from said predetermined location.

4. The system described in claim 1 wherein:

said polymerization station includes a water inlet that draws water from the sea, and uses that water to polymerize gaseous hydrocarbons received in said feedstock inlet.

5. An offshore hydrocarbon production system for producing hydrocarbons from a sea floor well that produces liquid and gaseous hydrocarbons, comprising:

a weathervaning vessel arrangement which floats at the sea surface and which is anchored to the sea floor;

a conduit which couples said well to said vessel arrangement to carry hydrocarbons thereto;

an oil/gas separator mounted on said vessel arrangement and having an inlet coupled to said conduit and having a liquid hydrocarbon outlet and a gas outlet;

a storage facility mounted on said vessel arrangement and having an inlet connected to said liquid hydrocarbon outlet of said separator;

a polymerization station mounted on said vessel arrangement, said station having a feedstock inlet and a polymerized hydrocarbon outlet connected to said storage facility, and said station including equipment that polymerizes gaseous hydrocarbon to produce liquid hydrocarbons;

a transport vessel which has a container for storing oil and which has a fluid-receiving coupling arrangement that is connectable to said storage facility, said fluid-receiving coupling arrangement constructed to hold substantially all fluid in a mixed arrangement so that fluid from said oil outlet of said separator and fluid from said polymerized hydrocarbon outlet are mixed together in said storage facility.

6. A method for producing hydrocarbon from an undersea reservoir that lies many kilometers from land and that contains both liquid and gaseous components, which includes directing the output of the well to a vessel assembly that is anchored to the sea floor in the vicinity of the well, characterized by:

separating the output of the well into an original liquid hydrocarbon component and a gaseous hydrocarbon component and storing the original liquid hydrocarbon component on the vessel assembly;

polymerizing the gaseous hydrocarbon component obtained in said step of separating, to obtain a hydrocarbon polymerized liquid component and storing said liquid polymerized component on said vessel assembly;

transferring said original liquid hydrocarbon component and said liquid polymerized component to a transport vessel, and then moving said transport vessel many kilometers to a refinery and transferring said components to said refinery.

7. The method described in claim 6 wherein:

said step of moving said transport vessel many kilometers to a refinery, includes moving said transport vessel while said original liquid hydrocarbon component and said liquid polymerized component are mixed together.

8. The method described in claim 7 wherein:

said step of storing said liquid polymerized component includes mixing said liquid polymerized component with said original liquid hydrocarbon component in a storage facility of said vessel arrangement.

9. The method described in claim 6 wherein:

said step of polymerizing includes reacting said gaseous hydrocarbon components at a temperature of at least 100° C. to polymerize said hydrocarbons and thereafter using sea water from around said vessel assembly to cool the heated and polymerized hydrocarbons and thereafter further cooling said polymerized hydrocarbons by mixing them with said original liquid hydrocarbon component in a storage facility of said vessel assembly.

* * * * *